US006138912A

United States Patent [19]

Mitsuno

[11] Patent Number: 6,138,912

[45] Date of Patent: Oct. 31, 2000

[54] VEHICLE IDENTIFICATION SYSTEM AND METHOD USING SIGNAL ARRIVAL ANGLE MEASUREMENT

[75] Inventor: Atsushi Mitsuno, Tokyo, Japan

[73] Assignee: NEC Corporation, Tokyo, Japan

[21] Appl. No.: 09/173,741

[22] Filed: Oct. 16, 1998

[30] Foreign Application Priority Data

Oct. 17, 1997 [JP] Japan ..... 9-285437

[51] Int. Cl.[7] ..... G07B 15/02

[52] U.S. Cl. ..... 235/384; 340/10.1; 340/10.2

[58] Field of Search ..... 235/384; 340/10.1, 340/10.2, 10.3, 10.6, 928

[56] References Cited

U.S. PATENT DOCUMENTS

| | | | |
|---|---|---|---|
| 4,057,803 | 11/1977 | Coleman | 343/113 R |
| 5,072,380 | 12/1991 | Randelman et al. | 235/384 X |
| 5,101,200 | 3/1992 | Swett | 340/937 |
| 5,310,999 | 5/1994 | Claus et al. | 235/384 |
| 5,440,109 | 8/1995 | Hering et al. | 235/384 |
| 5,451,758 | 9/1995 | Jesadanont | 235/384 |
| 5,644,119 | 7/1997 | Padula et al. | 235/384 |
| 5,710,556 | 1/1998 | Nishimura | 340/928 |
| 5,969,641 | 10/1999 | Nakamura et al. | 340/928 |

FOREIGN PATENT DOCUMENTS

| | | |
|---|---|---|
| 6-258425 | 9/1994 | Japan . |
| 7-325947 | 12/1995 | Japan . |
| 8-86864 | 4/1996 | Japan . |
| 8-287308 | 11/1996 | Japan . |

OTHER PUBLICATIONS

Japanese Office Action dated Nov. 30, 1999, with partial translation.

"Direction Finding Technology and Application to Radio–communication Vehicle Identification System" by Atsushi Mitsuno et al., NEC Technical Jounal, vol. 50, No. 7, Jul. 25, 1997, pp. 147–155.

"Application of Directional Finder to the Electronic Toll Collection System" by Yoshihiko Kuwahara et al., Technical Report of the Institute of Electronics Information and Communication Engineers, vol. 97, No. 55, May 22, 1997, pp. 41–48.

*Primary Examiner*—Michael G Lee
*Assistant Examiner*—Diane I. Lee
*Attorney, Agent, or Firm*—McGinn & Gibb, P.C.

[57] ABSTRACT

A communication vehicle identification apparatus includes first and second radio communication units, a directional finding unit, a vehicle classification unit, and a vehicle identification unit. The first radio communication unit is mounted on a vehicle. The second radio communication unit is placed at a gate through which the vehicle passes to perform radio communication with the first radio communication unit. The directional finding unit measures an arrival angle of a radio signal transmitted from the first radio communication unit with respect to a reference direction. The vehicle classification unit detects the vehicle shape using image data obtained by photographing the vehicle and outputs vehicle shape data. When the vehicle has reached a predetermined position on the gate, the vehicle identification unit determines whether the arrival angle output from the directional finding unit falls within an arrival angle range of the radio signal from the first radio communication unit, which is calculated using the vehicle shape data from the vehicle classification unit, and identifies the vehicle having the first radio communication unit on the basis of a determination result.

16 Claims, 10 Drawing Sheets

| No. | VEHICLE ID | COMMUNICATION ESTABLISHMENT TIME | FRAME NUMBER | SLOT NUMBER | ARRIVAL ANGLE |
|---|---|---|---|---|---|
| 1 | × × × × | ○ ○ ○ ○ | + + + | △ △ △ | * *.* * ° |
| 2 | | | | | |
| 3 | | | | | |
| 4 | | | | | |

FIG. 8

VEHICLE IDENTIFICATION SYSTEM AND METHOD USING SIGNAL ARRIVAL ANGLE MEASUREMENT

BACKGROUND OF THE INVENTION

The present invention relates to a vehicle identification apparatus and method of identifying a vehicle by radio communication between the vehicle and a structure through which the vehicle passes and, more particularly, to a vehicle identification apparatus and method using signal arrival angle measurement for specifying a vehicle on the basis of the arrival angle of a radio signal transmitted from the vehicle.

As one of radio communication systems, there is an ETC (Electronic Toll Collection) system which charges vehicles for use of a toll road by radio communication. The ETC system is constituted by a first radio communication unit and electronic payment means (e.g., an IC card) mounted on a vehicle, and a second radio communication unit set at the toll gate (gate) of a toll road to communicate with the first radio communication unit.

In such an ETC system, the toll of the toll road is collected upon radio communication from the gate to the vehicle when the vehicle passes through the gate. More specifically, the toll is paid from the electronic payment means of the vehicle upon charging processing by radio communication from the gate.

Vehicles passing through the gate include vehicles compatible with ETC (to be referred to as ETC vehicles hereinafter) and vehicles incompatible with ETC (to be referred to as non-ETC vehicles hereinafter). When a lane dedicated to ETC vehicles or a lane for both ETC and non-ETC vehicles is set at the gate, the operator at the gate can collect the toll without contacting the drivers of the ETC vehicles.

According to this ETC system, the toll of the toll road can be collected without stopping vehicles at the gate. With this system, economical loss due to traffic delay can be avoided, convenience for users can be improved, and the labor in charging operation can be decreased.

The above-described conventional ETC system will be described with reference to FIG. 12.

Referring to FIG. 12, when an ETC vehicle 142 enters a communication setting area A of a radio communication antenna 121, which is set at the gate, communication for ETC (to be referred to as ETC communication hereinafter) is established between the radio communication unit at the gate and a radio communication unit 141 of the ETC vehicle 142.

However, when a non-ETC vehicle (not shown) enters a lane dedicated for the ETC vehicles 142 or a lane for both ETC vehicles and non-ETC vehicles, communication with the non-ETC vehicle is not performed. In this case, "stop" is turned on at an indicator 105 to stop the non-ETC vehicle.

If the gate is at the entrance of the toll road, a ticketing machine 151 issues a ticket. If the gate is at the exit of the toll road, the clerk in a tollbooth 152 collects the toll. For a vehicle in violation of the stop instruction, the number or driver of the vehicle is photographed, and the driver is charged later.

The communication setting area A where communication for ETC is done is set in the range of several meters in front of the radio communication antenna 121 so that a plurality of vehicles are rarely simultaneously present in the area. However, since the communication channel is designed in consideration of the system margin, and limitations are imposed on beam shaping by the radio communication antenna 121, communication is sometimes established even outside the communication setting area A. The area where ETC communication is established will be referred to as a communication enabled area B.

The communication enabled area B is wider than the communication setting area A, and a plurality of vehicles can easily simultaneously enter the communication enabled area B. As shown in FIG. 13, the ETC vehicle 142 following a non-ETC vehicle 144 may enter the gate, and the non-ETC vehicle 144 and the ETC vehicle 142 may simultaneously be present in the communication enabled area B.

In this case, ETC communication is established not with the non-ETC vehicle 144 ahead but with the ETC vehicle 142 following the non-ETC vehicle 144. However, since the vehicle which has transmitted the ETC communication signal cannot be specified, the gate side fails to understand that the ETC procedure with the non-ETC vehicle 144 is completed and allows the non-ETC vehicle 144 to pass. In fact, the non-ETC vehicle 144 is not charged, so reliable toll collection processing cannot be performed.

SUMMARY OF THE INVENTION

It is an object of the present invention to provide a vehicle identification apparatus and method capable of specifying an ETC vehicle in a plurality of vehicles passing through the gate of a structure where the vehicles pass.

In order to achieve the above object, according to the present invention, there is provided a communication vehicle identification apparatus comprising first radio communication means mounted on a vehicle, second radio communication means placed at a gatethrough which the vehicle passes to perform radio communication with the first radio communication means, directional finding means for measuring an arrival angle of a radio signal transmitted from the first radio communication means with respect to a reference direction, vehicle classification means for detecting a shape of the vehicle on the basis of image data obtained by photographing the vehicle and outputting vehicle shape data, and vehicle identification means for, when the vehicle has reached a predetermined position on the gate, determining whether the arrival angle output from the directional finding means falls within an arrival angle range of the radio signal from the first radio communication means, which is calculated on the basis of the vehicle shape data from the vehicle classification means, and identifying the vehicle having the first radio communication means on the basis of a determination result.

BRIEF DESCRIPTION OF THE DRAWINGS

FIG. 8 is a view showing an example of a DF table shown in FIG. 11;

DESCRIPTION OF THE PREFERRED EMBODIMENT

The present invention will be described below in detail with reference to the accompanying drawings.

Figure 1:
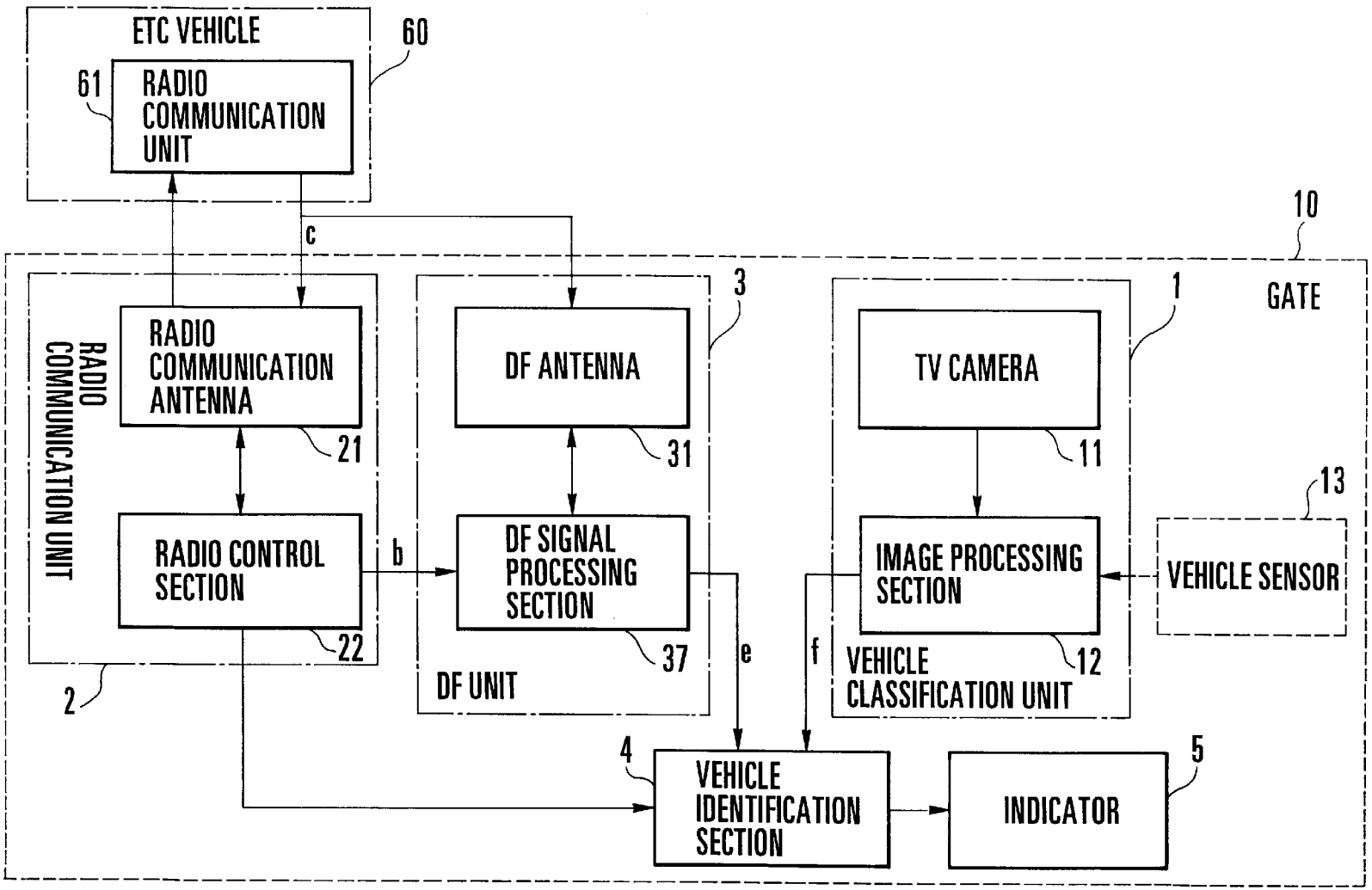
FIG. 1 is a block diagram showing the arrangement of an ETC system according to an embodiment of the present invention.

FIG. 1 shows the arrangement of an ETC system according to an embodiment of the present invention. An ETC system applied to the gate of a toll road will be described.

Referring to FIG. 1, the ETC system of this embodiment comprises a gate 10 having a vehicle classification unit 1 for classifying approaching (passing) vehicles one by one on the basis of photographed images, a radio communication unit 2 for performing ETC communication using a radio signal, a DF (Directional Finding) unit 3 for detecting the direction of the radio signal, a vehicle identification section 4 for specifying each approaching vehicle on the basis of the outputs from the radio communication unit 2 and the DF unit 3, and an indicator 5 for giving an instruction to each approaching vehicle, and an ETC vehicle 60 on which a radio communication unit for performing ETC communication with the radio communication unit 2 is mounted.

The vehicle classification unit 1 has a TV camera 11 as an image sensing means for photographing each approaching vehicle, and an image processing section 12 for processing image data output from the TV camera 11. The radio communication unit 2 has a radio communication antenna 21 for transmitting/receiving a radio signal to/from a radio communication unit 61 of the ETC vehicle 60, and a radio control section 22 for controlling radio communication through the antenna 21.

The DF unit 3 has a DF antenna 31 for receiving the radio signal from the radio communication unit 61 of the ETC vehicle 60, and a DF signal processing section 37 for processing a DF signal output from the DF antenna 31.

Figure 11:
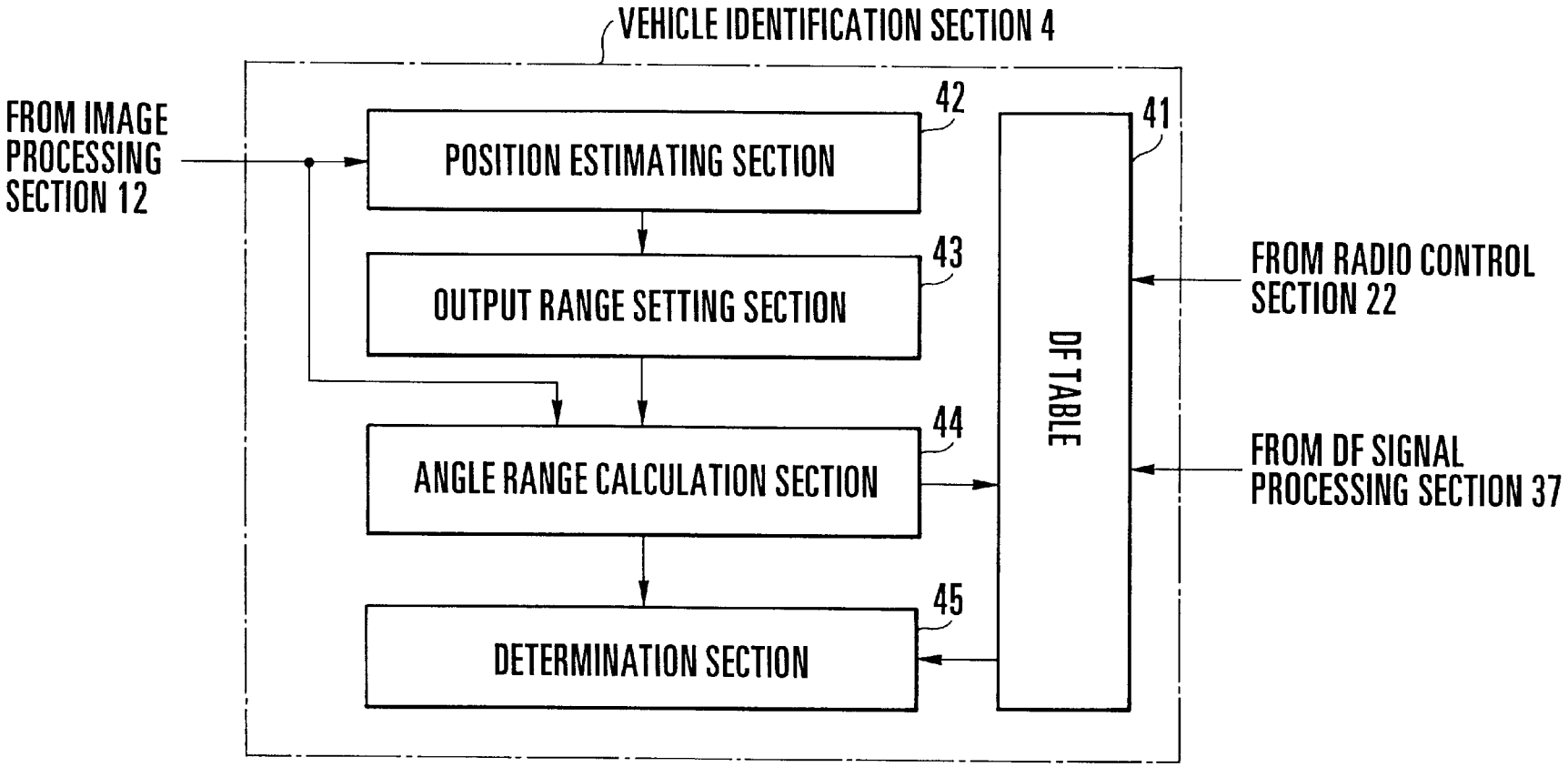
FIG. 11 is a block diagram showing the arrangement of the vehicle identification section shown in FIG. 1.
Figure 12:
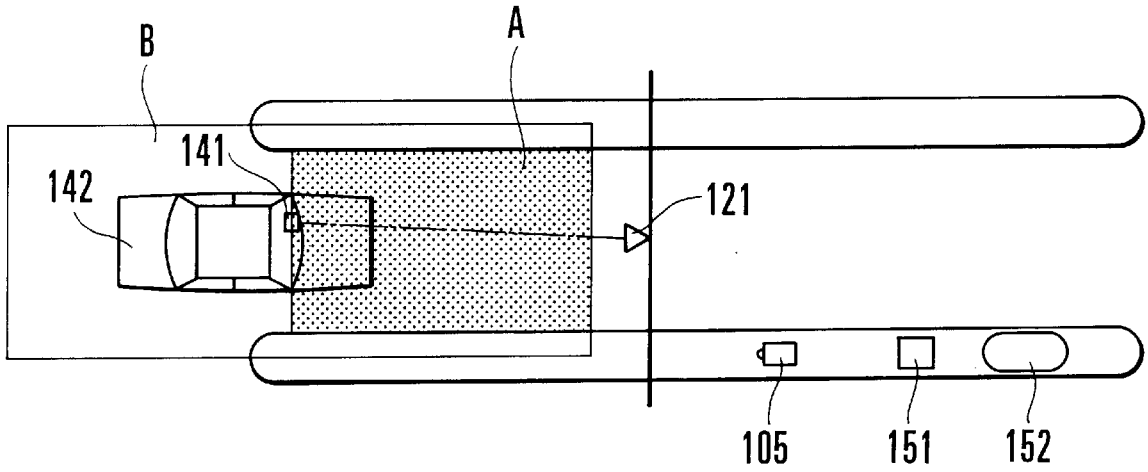
FIG. 12 PRIOR ART
FIG. 12 is a plan view schematically showing the gate portion of a conventional ETC system.
Figure 13:
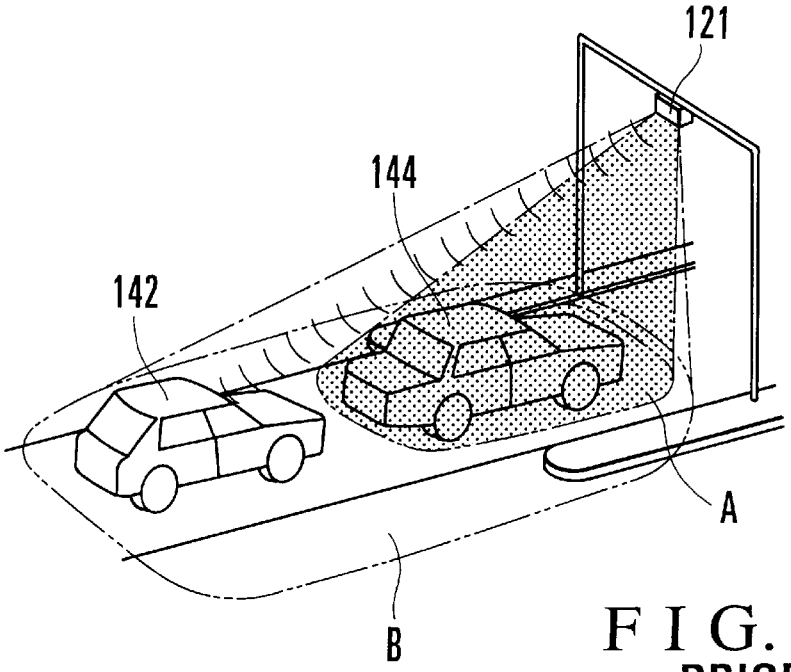
FIG. 13 PRIOR ART
FIG. 13 is a perspective view of the gate portion of the ETC system shown in FIG. 12.

As shown in FIG. 11, the vehicle identification section 4 comprises a DF table 41 prepared on the basis of input data, a position estimating section 42 for estimating the setting position of the radio communication unit 61 in the ETC vehicle 60 on the basis of vehicle shape data from the image processing section 12, an output range setting section 43 for setting the DF radio wave output range on the basis of the estimated setting position from the position estimating section 42, an angle range calculation section 44 for calculating the arrival angle range of the DF radio wave on the basis of the vehicle shape data from the image processing section 12 and the set output range from the output range setting section 43, and a determination section 45 for determining whether the radio wave arrival angle read out from the DF table 41 falls within the calculated angle range from the angle range calculation section 44 to identify the ETC vehicle 60.

FIG. 8 shows an example of the DF table 41 shown in FIG. 11. In the DF table 41, the vehicle ID, communication establishment time, the frame number, and slot number output from the radio control section 22, and the radio wave arrival angle output from the DF signal processing section 37 are updated and stored.

As shown in FIG. 1, the output side of the TV camera 11 is connected to the image processing section 12. The radio communication antenna 21 is connected to the radio control section 22. The DF antenna 31 is connected to the DF signal processing section 37. The output side of the radio control section 22 is connected to the input side of the DF signal processing section 37. The output sides of the image processing section 12, the radio control section 22, and the DF signal processing section 37 are connected to the vehicle identification section. The indicator 5 is connected to the output side of the vehicle identification section 4.

Figure 2:
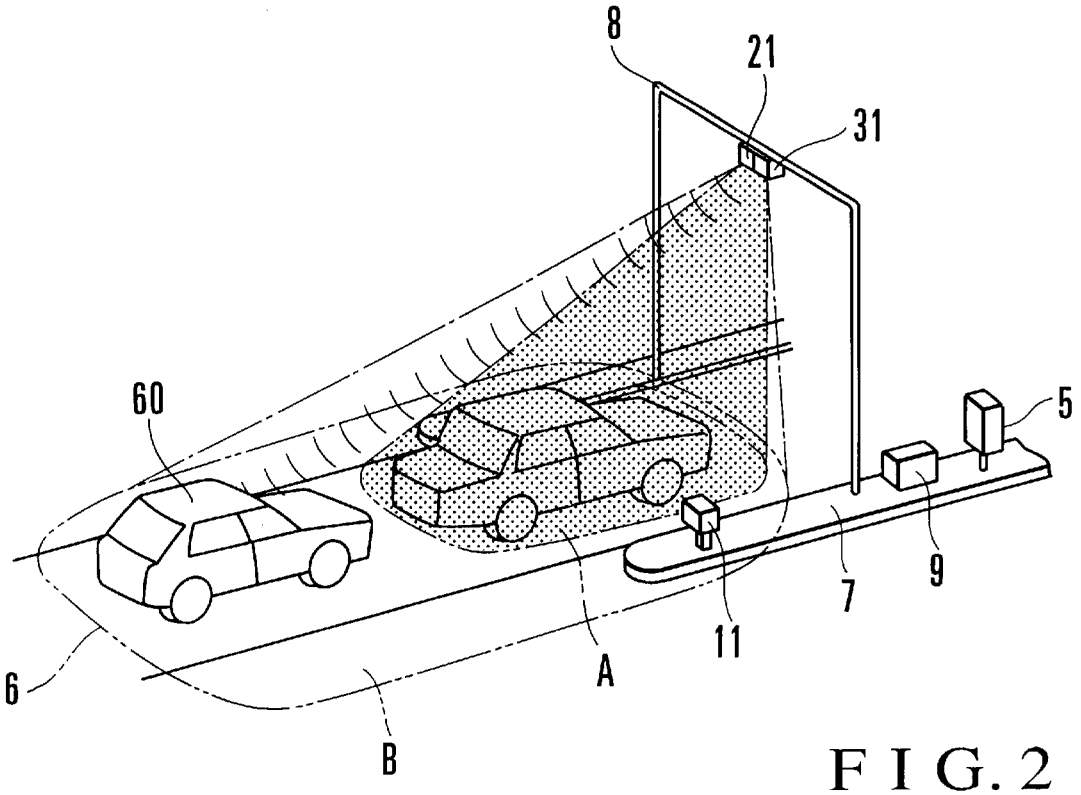
FIG. 2 is a perspective view of the gate portion of the ETC system shown in FIG. 1.

FIG. 2 shows the gate portion in FIG. 1. As shown in FIG. 2, an arch 8 is placed across an ETC lane 6. The radio communication antenna 21 and the DF antenna 31 attached side by side to the arch 8 almost immediately above the ETC lane 6.

The TV camera 11 is set on a shoulder 7 near a communication setting area A of the radio communication antenna 21. A box 9 which accommodates the image processing section 12, the radio control section 22, the DF signal processing section 37, and the vehicle identification section 4, and the indicator 5 are also set on the shoulder 7.

The radio communication unit 61 is mounted on the dashboard of the ETC vehicle 60 entering the ETC lane 6.

Figure 3:
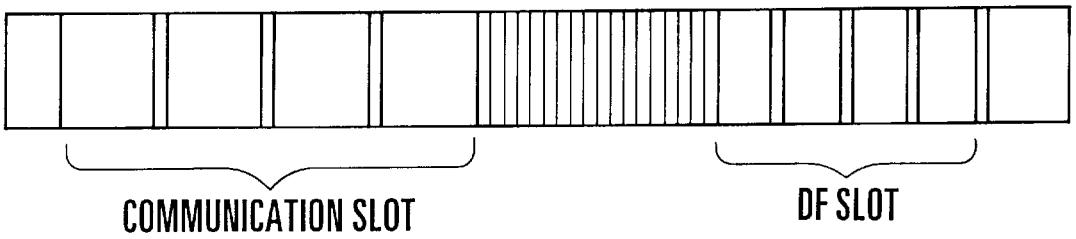
FIG. 3 is a view showing the frame format of a radio signal transferred between an ETC vehicle and the gate shown in FIG. 1.
Figure 4A:
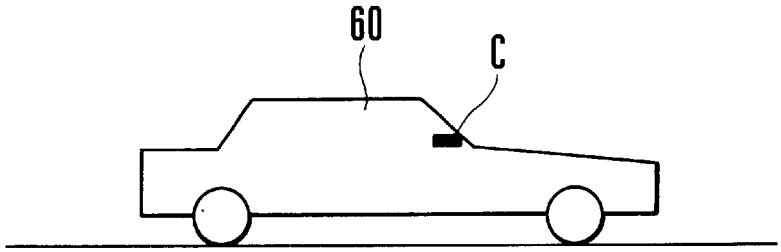
FIGS. 4A to 4E are views showing the radio communication unit setting positions in modeled vehicles.
Figure 4B:
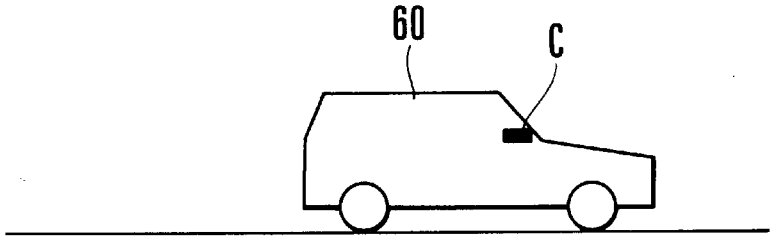
Figure 4C:
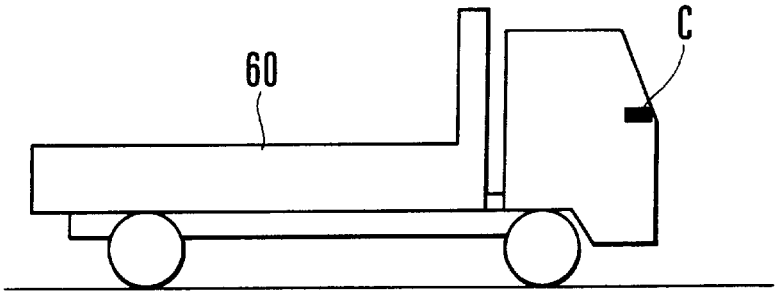
Figure 4D:
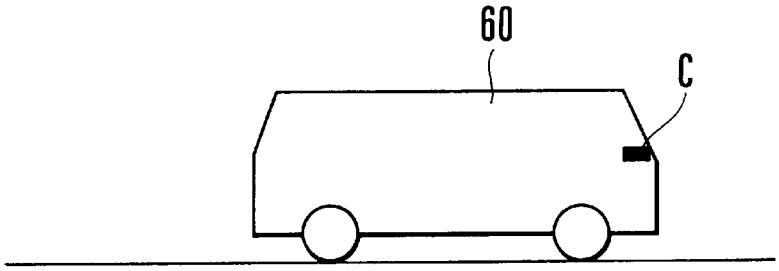
Figure 4E:
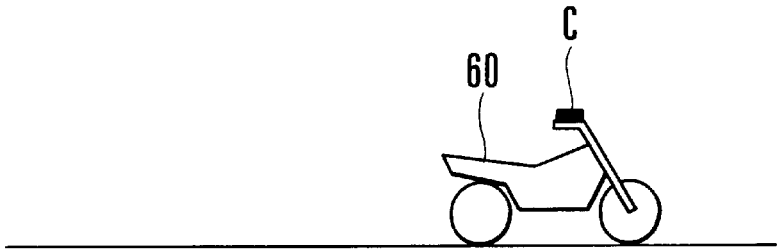

FIG. 3 shows the frame format of a radio signal to be transferred between the radio communication units 2 and 61 for ETC communication. In correspondence with the communication slot shown in FIG. 3, the radio control section 22 performs ETC communication with the radio communication unit 61 in a communication enabled area B in accordance with a predetermined communication protocol. In correspondence with the DF slot shown in FIG. 3, the radio control section 22 instructs the DF signal processing section 37 to sample the radio signal transmitted from the radio communication unit 61.

The radio control section 22 assigns, to the radio communication unit 61 in the communication enabled area B, time at which ETC communication is to be performed and time at which the DF radio signal is to be transmitted. With this arrangement, even when a plurality of ETC vehicles 60 are simultaneously present in the communication enabled area B, the radio control section 22 can time-divisionally perform ETC processing and DF processing for every radio communication unit 61.

Each of the communication slot and the DF slot shown in FIG. 3 has four slots, so the radio control section 22 can simultaneously communicate with four ETC vehicles 60 in the communication enabled area B. The number of slots constituting the communication slot or DF slot corresponds to the maximum number of vehicles capable of simultaneously running through the communication enabled area B.

In FIG. 1, the DF antenna 31 receives the DF radio signal transmitted from the radio communication unit 61 and supplies the radio signal to the DF signal processing section 37. Since the DF antenna 31 is set next to the radio communication antenna 21, the effective measurement range of the DF unit 3 can be almost matched with the communication enabled area B of the radio communication unit 2.

The DF signal processing section 37 processes the radio signal received by the DF antenna 31 to measure the radio wave arrival angle. The radio wave arrival angle means the angle made by the radio wave reception direction and the vertical direction.

The DF signal processing section 37 operates on the basis of the principle of an interferometer for estimating the arrival direction from the phase difference between signals received by a 2-element array antenna.

This will be described in detail. Assume that a radio wave having a wavelength $\lambda$ is incident on a 2-element array antenna with an element interval d at an angle $\theta$ with respect to the vertical direction. A phase difference $\Delta\phi$ between received signals XM and XN (the received signals XM and XN are complex signals) received by reception elements M and N of the 2-element array antenna is given by:

$$\Delta\phi = XM\ XN^*/|XM\ XN| = \exp\{2\pi d \sin(\theta/\lambda)\} \quad (1)$$

where * represents complex conjugate. When the phase difference $\Delta\phi$ is obtained from the received signals XM and XN, the radio wave arrival angle $\theta$ can be calculated from equation (1).

The TV camera 11 of the vehicle classification unit 1 is placed on the shoulder 7 of the ETC lane 6 in the lane crossing direction, as described above, to photograph the side surface of a vehicle entering the ETC lane 6. The image processing section 12 detects the vehicle shape on the basis of image data output from the TV camera 11, models the detected vehicle shape, and outputs it to the vehicle identification section 4 as vehicle shape data.

As the image sensing means, the TV camera 11 is used. However, any image sensing means can be used as far as it provides image data allowing the vehicle identification section 4 to estimate the setting position of the radio communication unit 61. For example, the image sensing means may be a device which has a laser source placed above the ETC lane 6 and a CCD camera set in the lane crossing direction with respect to the light source, and senses the reflected light of the light beam projected in the vehicle running direction of the ETC lane 6.

The vehicle identification section 4 calculates the arrival angle range of the radio wave for DF on the basis of the vehicle shape data output from the image processing section 12. The vehicle identification section 4 identifies the ETC vehicle 60 by determining whether the radio wave arrival angle falls within the calculated arrival angle range when the front portion of the vehicle approaching the gate reaches a predetermined position.

A method of calculating the radio wave arrival angle range will be described next with reference to FIGS. 4A to 4E, 5, and 6.

As shown in FIGS. 4A to 4E, a setting position (range) C of the radio communication unit 61 can be estimated from the modeled shape of the side surface of a vehicle. When it is assume that the radio communication unit 61 is set on the dashboard of a four-wheeled vehicle, the radio communication unit 61 is estimated to be at one of the setting positions C shown in FIGS. 4A to 4D. When it is assumed that the radio communication unit 61 is set on the front body including the handlebar of a motorcycle, the radio communication unit 61 is estimated to be at the setting position C shown in FIG. 4E.

Figure 5:
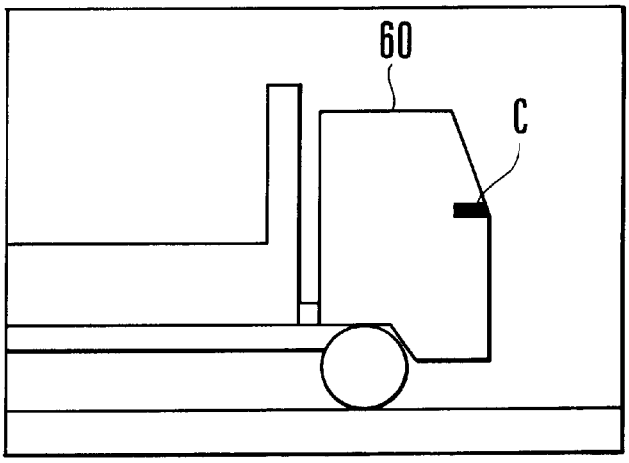
FIG. 5 is view showing a vehicle shape modeled on the basis of image data of the front portion of a vehicle and the radio communication unit setting position.

The vehicle image obtained by the TV camera 11 need not always be the full image of the vehicle. For example, when the image of the front portion of the vehicle is obtained, the vehicle identification section 4 can estimate the setting position C of the radio communication unit 61 by modeling the vehicle shape by the image processing section 12, as shown in FIG. 5.

Figure 6:
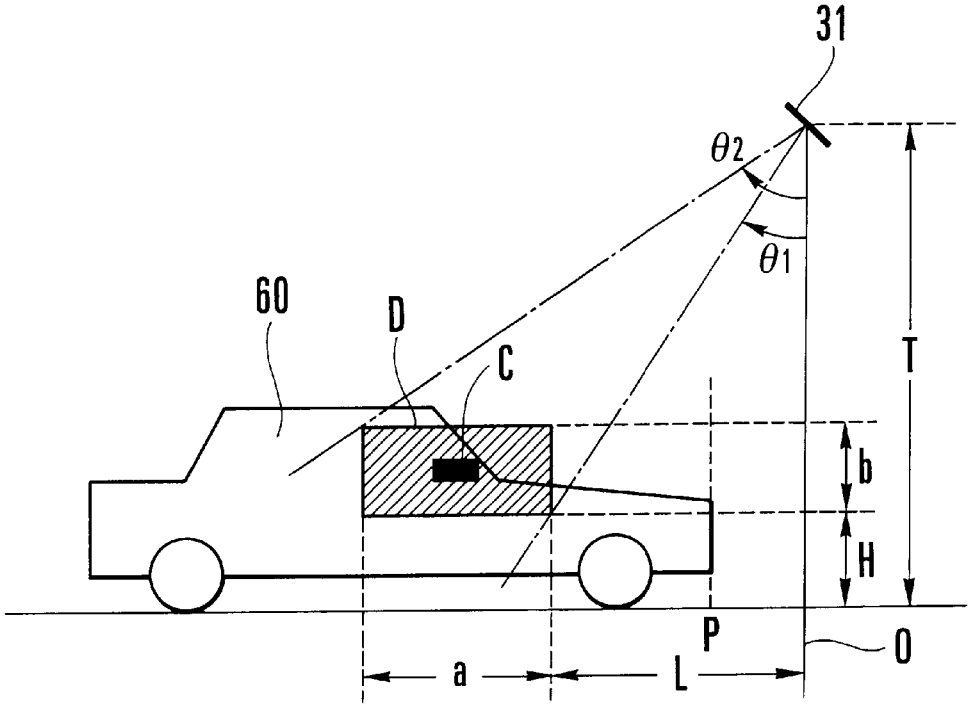
FIG. 6 is a view for explaining a method of calculating the arrival angle range of a radio signal for directional finding (DF)

The arrival angle data of the radio wave obtained by detecting that the vehicle approaching the gate reaches a predetermined position is arrival angle data of a radio wave sent from a range D including the setting position C of the radio communication unit 61 mounted on the ETC vehicle 60, as shown in FIG. 6, because of a delay error. This range D will be called a DF signal output range.

The delay error is based on delay according to radio wave arrival angle calculation by the DF unit 3 and a time after the ETC vehicle 60 has reached the predetermined position until the arrival angle data is read out. Since this delay error can be estimated, the DF signal output range D can be set on the basis of the setting position C of the radio communication unit 61.

For the descriptive convenience, the DF signal output range D is defined as a rectangular range with a length a in the vehicle running direction and a height b.

Referring to FIG. 6, letting L be the distance from the DF signal output range D to an DF angle origin O and H be the height of the DF signal output range D, the arrival angle of the radio wave sent from the DF signal output range D is $\theta 1$ to $\theta 2$. At this time, $$\tan\theta 1 = L/(T-H)$$

$$\tan\theta 2 = (L+a)/(T-H-b)$$

Therefore, the angles $\theta 1$ and $\theta 2$ are given by equations (2) and (3) below, respectively:

$$\theta 1 = \tan^{-1}\{L/(T-H)\} \quad (2)$$

$$\theta 2 = \tan^{-1}\{(L+a)/(T-H-b)\} \quad (3)$$

When the radio wave arrival angle falls within the arrival angle range ($\theta 1$ to $\theta 2$) obtained from equations (2) and (3) when the vehicle reaches a predetermined position P shown in FIG. 6, the vehicle identification section 4 identifies this vehicle as the ETC vehicle 60.

Since the radio wave arrival angle measured by the DF unit 3 contains a DF error, the arrival angle range ($\theta 1$ to $\theta 2$) is actually set in consideration of the DF error.

The "predetermined position P" is set such that the DF unit 3 can detect the radio wave arrival angle. At a gate where vehicles enter in a single file, the arrival angle range ($\theta 1$ to $\theta 2$) of a radio wave from a vehicle can be prevented from overlapping the arrival angle ranges ($\theta 1$ to $\theta 2$) of radio waves from vehicles sandwiching the vehicle by appropriately setting the DF signal output range D.

The operation of the ETC system shown in FIG. 1 will be described next with reference to FIGS. 7A to 7E, 8, and 9.

First, the operations of the radio communication unit 2 and the DF unit 3 will be described with reference to FIGS. 7A to 7E.

Figures 7A, 7B, 7C, 7D, 7E:
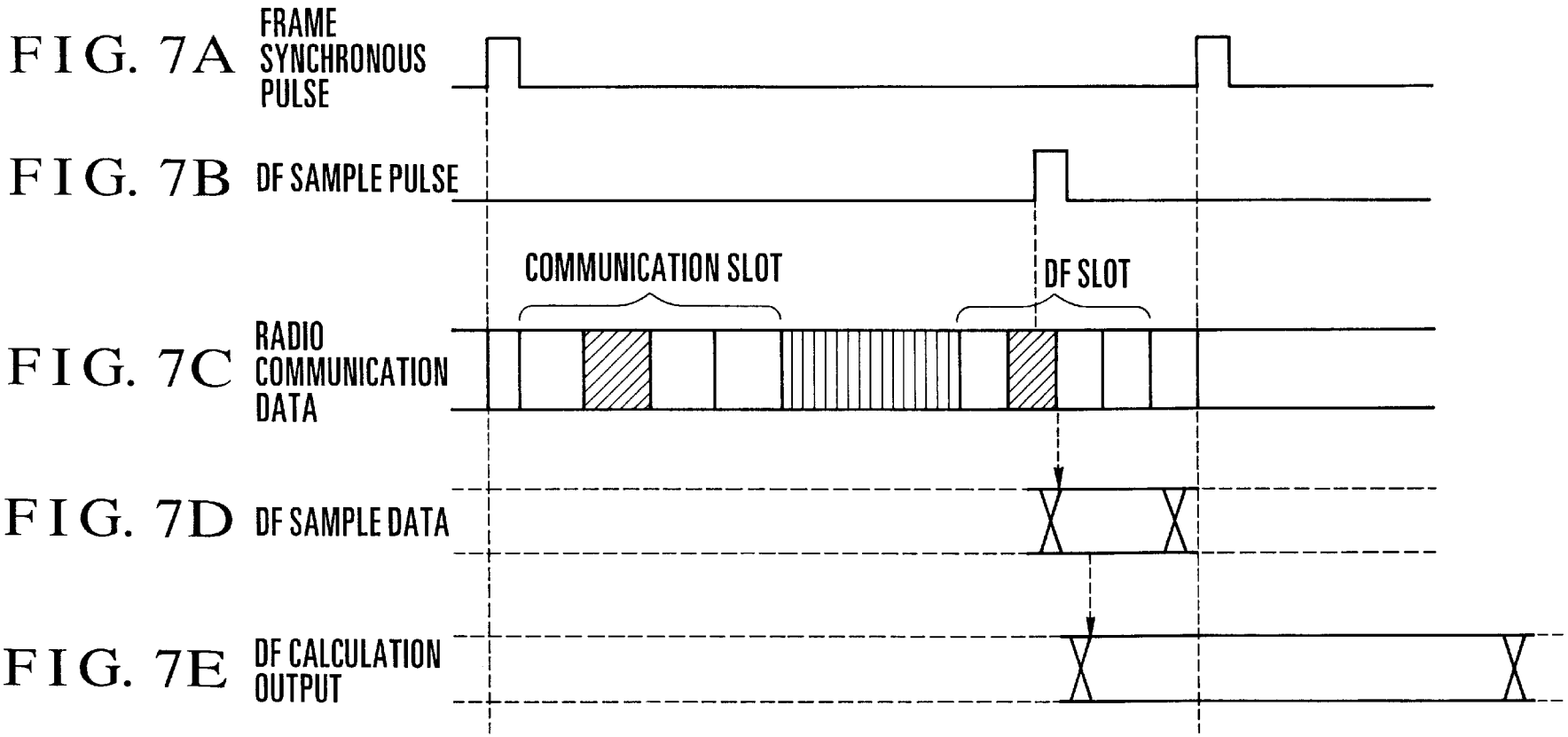
FIGS. 7A to 7E are timing charts showing the operations of the radio communication unit and the DF unit on the gate side shown in FIG. 1.

The radio communication unit 2 outputs a frame synchronous pulse a (FIG. 7A) at the start of each frame of radio communication data c (FIG. 7C). This frame synchronous pulse is used to, e.g., reset the slot counter for counting the slot number. When the ETC vehicle 60 enters the ETC lane 6 at the gate of the toll road and comes to the communication enabled area B of the radio communication antenna 21, the radio communication unit 61 of the ETC vehicle 60 transmits a signal to the radio communication unit 2 at the gate to request a right for ETC communication.

The signal from the ETC vehicle 60 is received by the radio communication antenna 21 and sent to the radio control section 22. The radio control section 22 registers the ETC vehicle 60 which has transmitted the signal. The radio control section 22 also assigns a communication slot for ETC communication with the radio communication unit 61 and a DF slot in which the radio communication unit 61 transmits a DF radio signal (FIG. 7C).

The radio control section 22 performs ETC communication with the radio communication unit 61 using the assigned communication slot. The radio control section 22 also outputs a DF sample pulse b to the DF signal processing section 37 in correspondence with the assigned DF slot (FIG. 7B).

The radio control section 22 outputs the vehicle ID unique to the ETC vehicle 60, the communication establishment time, and the frame and slot numbers for signal collation to the vehicle identification section 4.

The DF signal processing section 37 samples the DF slot corresponding to the radio communication data c transmitted from the radio communication unit 61 of the ETC vehicle 60 by using the DF sample pulse b to obtain DF sample data d (FIG. 7D). The DF signal processing section 37 performs DF calculation based on the principle of an interferometer for the resultant DF sample data d to obtain the arrival angle of the radio signal, and a calculation result (arrival angle) e to the vehicle identification section 4 (FIG. 7E).

Even after ETC communication is ended, the radio communication unit 61 of the ETC vehicle 60 continues to transmit the DF radio signal until the ETC vehicle 60 reaches the predetermined position P. During this time, the DF signal processing section 37 continues to measure the arrival angle e of the radio signal from the ETC vehicle 60 and output it to the vehicle identification section 4.

Until the ETC vehicle 60 reaches the predetermined position P, and vehicle shape data f is output from the vehicle classification unit 1, the vehicle identification section 4 continues to sequentially update the data stored in the DF table 41 to new data for every sampling period.

On the other hand, when the TV camera 11 of the vehicle classification unit 1 outputs the image data of the vehicle 60, the image processing section 12 detects the shape of the vehicle 60 on the basis of the image data. Upon detecting that the front end of the vehicle 60 has reached the predetermined position P on the image, the image processing section 12 models the shape of the vehicle 60 and outputs it to the vehicle identification section 4 as the vehicle shape data f.

The operation of the vehicle identification section 4 will be described next with reference to the flow chart of FIG. 9.

Figure 9:
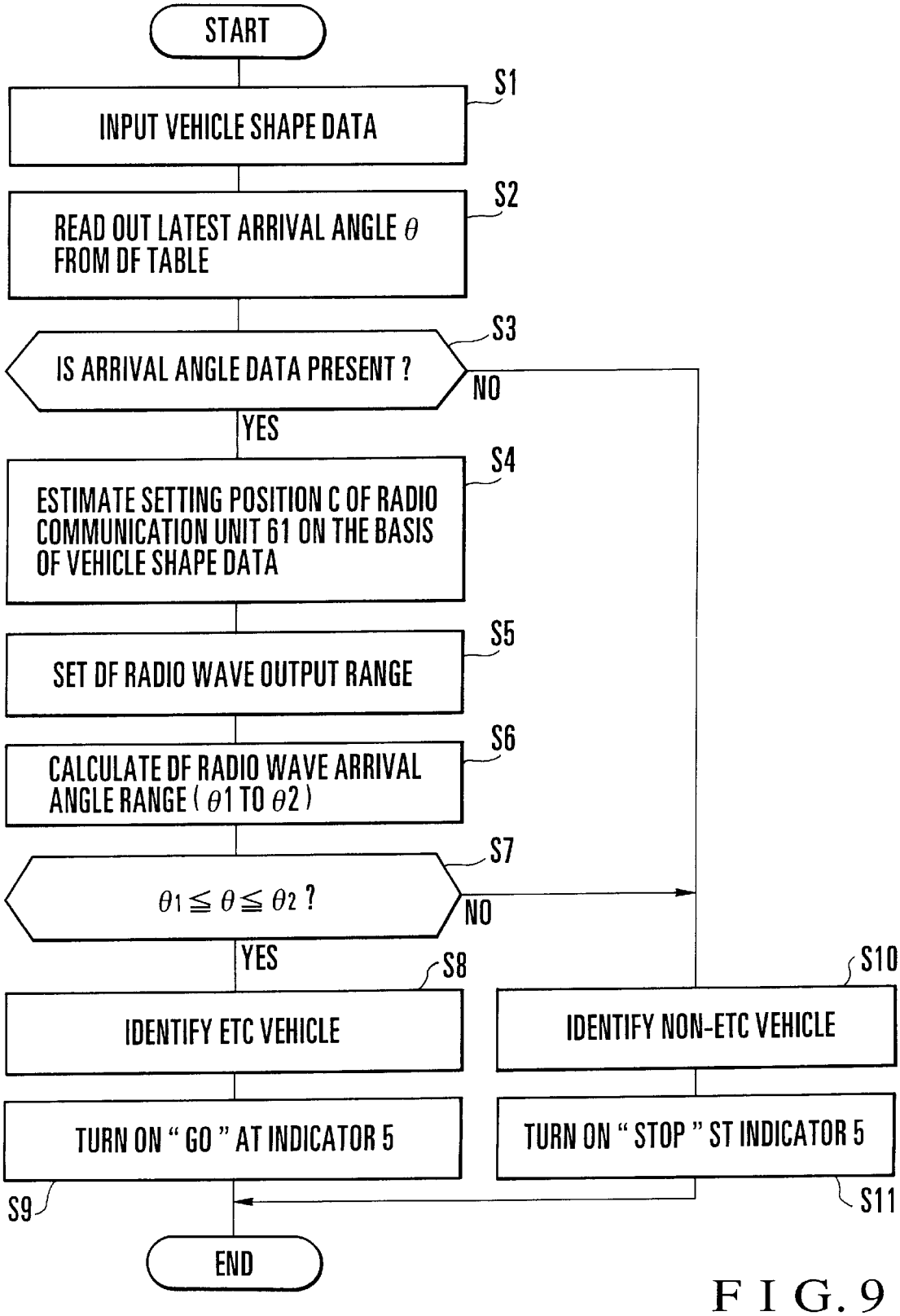
FIG. 9 is a flow chart showing the operation of a vehicle identification section shown in FIGS. 1 and 11.

Referring to FIG. 9, when the vehicle shape data f is input from the image processing section 12 to the vehicle identification section 4 (step S1), the vehicle identification section 4 reads out the arrival angle θ of the latest DF radio signal stored in the DF table 41 (step S2). At this time, it is determined whether the radio signal arrival angle data is stored in the DF table 41 (step S3).

If YES in step S3, the position estimating section 42 of the vehicle identification section 4 estimates the setting position C of the radio communication unit 61 in the ETC vehicle 60 on the basis of the vehicle shape data input in step S1 (step S4). Subsequently, the output range setting section 43 sets the DF signal output range D on the basis of the estimated setting position C (step S5).

The angle range calculation section 44 calculates the arrival angle range (θ1 to θ2) of the DF radio wave on the basis of the vehicle shape data input in step S1 and the DF signal output range D set in step S5 (step S6).

The determination section 45 compares the radio wave arrival angle θ read out in step S2 with the arrival angle range (θ1 to θ2) calculated in step S6 (step S7). If the arrival angle θ of the radio signal falls within the arrival angle range (θ1 to θ2), the vehicle identification section 4 determines that the radio signal is transmitted from the vehicle at the predetermined position P and identifies the object as the ETC vehicle 60 (step S8).

If the arrival angle θ of the radio wave falls outside the arrival angle range (θ1 to θ2), the vehicle identification section 4 determines that the radio signal is not transmitted from the vehicle at the predetermined position P and identifies the object as a non-ETC vehicle (step S10).

If NO in step S3, the vehicle identification section 4 determines that the vehicle at the predetermined position P is not transmitting the DF radio wave and identifies the object as a non-ETC vehicle (step S10).

When the object is identified as the ETC vehicle 60 in step S8, ETC is properly performed between the ETC vehicle 60 and the gate 10 by an electronic payment means (not shown). For this reason, the vehicle identification section 4 turns on "go" at the indicator 5 to allow the ETC vehicle 60 to pass (step S9).

When the object is identified as a non-ETC vehicle in step S10, ETC is not performed between the non-ETC vehicle and the gate 10. The vehicle identification section 4 turns on "stop" at the indicator 5 to stop the non-ETC vehicle (step S11), and the ticketing machine issues a ticket or the clerk collects the toll. Alternatively, the vehicle number or driver is photographed to charge the driver later for use of the road.

When a plurality of ETC vehicles 60 continuously enter the communication enabled area B of the radio communication antenna 21, the radio control section 22 assigns different communication slots and DF slots to the ETC vehicles 60. For this reason, the radio control section 22 can time-divisionally perform ETC processing for each ETC vehicle 60. The DF signal processing section 37 can time-divisionally measure the arrival angle of the radio wave transmitted from each ETC vehicle 60. Hence, even when a plurality of ETC vehicles 60 are simultaneously present in the communication enabled area B, it can be appropriately determined whether each vehicle is the ETC vehicle 60.

Figure 10:
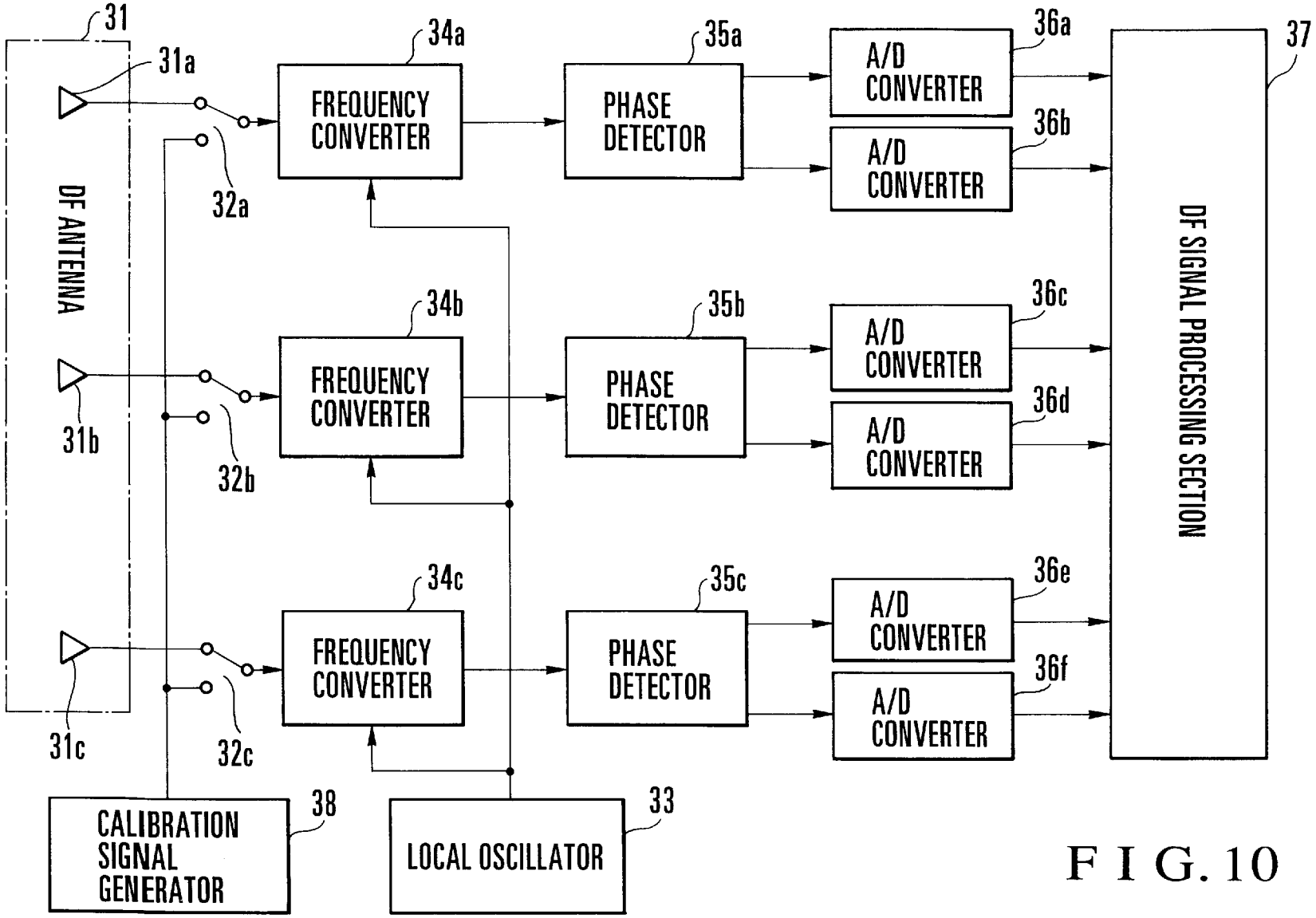
FIG. 10 is a block diagram showing the arrangement of the DF unit shown in FIG. 1.

FIG. 10 shows the arrangement of the DF unit 3. As shown in FIG. 10, the DF unit 3 comprises the DF antenna 31 (FIG. 1) having array antennas 31*a*, 31*b*, and 31*c*, change-over switches 32*a*, 32*b*, and 32*c*, a local oscillator 33, frequency converters 34*a*, 34*b*, and 34*c*, phase detectors 35*a*, 35*b*, and 35*c*, A/D (analog/digital) converters 36*a*, 36*b*, 36*c*, 36*d*, 36*e*, and 36*f*, the DF signal processing section 37 (FIG. 1), and a calibration signal generator 38.

Each of the array antennas 31*a* to 31*c* is connected to one input terminal of a corresponding one of the change-over switches 32*a* to 32*c*. The calibration signal generator 38 is connected to the other input terminal of each of the change-over switches 32*a* to 32*c*. The input side of each of the frequency converters 34*a* to 34*c* is connected to the output terminal of a corresponding one of the change-over switches 32*a* to 32*c* and the local oscillator 33. The output side of each of the frequency converters 34*a* to 34*c* is connected to a corresponding one of the phase detectors 35*a* to 35*c*.

The two output sides of the phase detector 35*a* are connected to the DF signal processing section 37 through the A/D converters 36*a* and 36*b*. The two output sides of the phase detector 35*b* are connected to the DF signal processing section 37 through the A/D converters 36*c* and 36*d*. The two output sides of the phase detector 35*c* are connected to the DF signal processing section 37 through the A/D converters 36*e* and 36*f*.

Since the DF unit 3 measures the arrival angle of the radio wave on the basis of the principle of an interferometer, each of the array antennas 31*a* to 31*c* is constituted by the two reception elements M and N (not shown). The array antennas 31*a* to 31*c* are arranged along the ETC lane 6.

The array antennas 31*a* to 31*c* receive a DF radio signal and supply the received signal to the frequency converters 34*a* to 34*c*, respectively. Each of the change-over switches 32*a* to 32*c* switches between the received signal from a corresponding one of the array antennas 31*a* to 31*c* and a calibration signal sent from the calibration signal generator 38.

The local oscillator 33 outputs a signal having a predetermined frequency to the frequency converters 34*a* to 34*c*. Each of the frequency converters 34*a* to 34*c* converts the received signal from a corresponding one of the array antennas 31*a* to 31*c* into an IF (Intermediate Frequency) signal which allows phase detection by using the output signal from the local oscillator 33. The phase detectors 35*a* to 35*c* detect the phases of the received signals which are frequency-converted by the frequency converters 34*a* to 34*c*, respectively.

The A/D converters 36*a* to 36*f* converts the received signals whose phases are detected by the phase detectors 35*a* to 35*c* into digital signals, respectively. The DF signal processing section 37 estimates the arrival angle of the received signal from the output signals from the A/D converters 36*a* to 36*f* on the basis of the principle of an interferometer.

The operation of the DF unit 3 having the above arrangement will be described next.

The DF radio signal transmitted from the radio communication unit 61 of the ETC vehicle 60 is received by the array antennas 31*a* to 31*c*. The signals received by the array antennas 31*a* to 31*c* are sent to the frequency converters 34*a* to 34*c* through the change-over switches 32*a* to 32*c*, respectively.

Each of the frequency converters 34*a* to 34*c* mixes the received signal with the signal generated by the local oscillator 33 to convert the received signal into an IF signal which allows phase detection. The phases of the received signals frequency-converted by the frequency converters 34*a* to 34*c* are detected by the phase detectors 35*a* to 35*c*, respectively, converted into digital signals by the A/D converters 36*a* to 36*f*, and sent to the DF signal processing section 37.

The received signals converted into digital signals by the A/D converters 36*a* to 36*f* are processed by the DF signal processing section 37 on the basis of the principle of an interferometer to estimate the arrival angle of the received signal in each system. To estimate the arrival angle from the signals received by the three array antennas 31*a* to 31*c*, a cost function P(θ) represented by equation (4) is introduced:

$$P(\theta) = \frac{1}{\sum_{ij}\left(\frac{X_i X_j^*}{|X_i X_j|} - \frac{R(\theta)_i R(\theta)_j^*}{|R(\theta)_i R(\theta)_j|}\right)^2} \quad (4)$$

where $R(\theta)_i$ is a reception response to the radio signal received by a reception element i (i is M and N) of each of the array antennas 31*a* to 31*c* at the angle θ.

When the phase difference Δφ between the received signals XM and XN received by the reception elements M and N, respectively, is calculated for reception responses RM(θ) and RN(θ) changed at a predetermined interval, the cost function P(θ) represented by equation (4) is maximized at an angle corresponding to the reception signal arrival direction. The DF signal processing section 37 can estimate the signal arrival angle by obtaining the maximum value of the cost function P(θ).

To calibrate the amplitude variation and phase variation due to the temperature of, e.g., cables connecting the array antennas 31*a* to 31*c* and the frequency converters 34*a* to 34*c*, respectively, the change-over switches 32*a* to 32*c* are switched to the calibration signal generator 38 side to calibrate the amplitude and phase of each system using the calibration signal.

In FIG. 10, the DF antenna 31 is constituted by the three array antennas 31*a* to 31*c*. However, the number of array antennas 31*a* to 31*c* of the DF antenna 31 is not limited to three.

The above embodiment has been described on the assumption that the radio communication unit 61 is mounted on the dashboard of the ETC vehicle 60 (in a motorcycle, on the front body including the handlebar). However, the present invention can be applied even when the radio communication unit 61 is mounted on another place where communication can be performed.

In the above embodiment, the image processing section 12 detects a vehicle at the predetermined position P on the basis of image data. However, as shown in FIG. 1, a dedicated sensor 13 may be set at the position P to detect the front end of the vehicle. In this case, since vehicle position detection processing can be omitted, processing in the image processing section 12 is simplified.

In the above embodiment, the present invention is applied to the ETC system used in a toll road. However, the application field of the present invention is not limited to this. For example, the present invention can be applied to automatically collect a toll by radio communication at the entrance gate or exit gate of a toll parking lot or the like. The present invention is also effective to specify a communication vehicle of a plurality of vehicles passing through the gate of an equipment where vehicles pass without collecting the toll.

As has been described above, according to the present invention, when the radio signal arrival angle measured by the directional finding means falls within the arrival angle range calculated by the vehicle identification means on the basis of the vehicle shape, the vehicle is identified as a vehicle compatible with the system. At a gate where vehicles approach in a single file, even when the plurality of vehicles run at a small interval, the radio signal arrival angle ranges calculated for the vehicles do not overlap. For this reason, even when a plurality of vehicles run close to each other, vehicles compatible with the system can be specified.

The directional finding means time-divisionally measures the arrival angle of the radio signal transmitted from the radio communication means mounted on the vehicle. Therefore, even when a plurality of vehicles compatible with the system are simultaneously present in the communication area of the radio communication means set at the gate, it can be appropriately determined whether each vehicle is a vehicle compatible with the system.

What is claimed is:

1. A communication vehicle identification apparatus comprising:

first radio communication means mounted on a vehicle;

second radio communication means placed at a gate through which the vehicle passes to perform radio communication with said first radio communication means;

directional finding means for measuring an arrival angle of a radio signal transmitted from said first radio communication means with respect to a reference direction;

vehicle classification means for detecting a shape of the vehicle using image data obtained by photographing the vehicle and outputting vehicle shape data; and vehicle identification means for, when the vehicle has reached a predetermined position on the gate, determining whether the arrival angle output from said directional finding means falls within an arrival angle range of the radio signal from said first radio communication means, which is calculated using the vehicle shape data from said vehicle classification means, and identifying the vehicle having said first radio communication means using a determination result.

2. The apparatus according to claim 1, wherein said vehicle identification means comprises estimation means for estimating a setting position of said first radio communication means using the vehicle shape data from said vehicle classification means, calculation means for, when the vehicle has reached the predetermined position, calculating the arrival angle range of the radio signal from said first radio communication means using the estimated setting position of said first radio communication means, and determination means for, when the arrival angle measured by said directional finding means falls within the arrival angle range calculated by said calculation means, determining that the vehicle reaching the predetermined position comprises the vehicle having said first radio communication means.

3. The apparatus according to claim 1, wherein said apparatus further comprises detection means for detecting that the vehicle has reached the predetermined position on the gate, and the predetermined position is set at a position where said directional finding means can detect the arrival angle of the radio signal from said first radio communication means.

4. The apparatus according to claim 1, wherein said vehicle classification means comprises image sensing means for photographing a side surface portion of the vehicle and outputting image data, and image processing means for detecting the shape of the vehicle using the image data from said image sensing means and outputting the vehicle shape data.

5. The apparatus according to claim 4, wherein said image processing means models the shape of a vehicle using the detected shape of the vehicle and outputs modeled vehicle shape data.

6. The apparatus according to claim 1, wherein when a plurality of vehicles are present in a communication area where radio communication can be performed, said second radio communication means time-divisionally assigns a radio signal transmission time to said first radio communication means of each of the plurality of vehicles, and said directional finding means time-divisionally measures the arrival angle of the radio signal transmitted from said first radio communication means.

7. A communication vehicle identification method comprising:

extracting image data when a vehicle having a first radio communication unit passes through a gate at which a second radio communication unit is placed;

measuring an arrival angle of a radio signal from said first radio communication unit with respect to a reference direction;

detecting a vehicle shape using the extracted image data when the vehicle has reached a predetermined position;

estimating a setting position of said first radio communication unit using the detected vehicle shape;

calculating an arrival angle range of the radio signal from said first radio communication unit with respect to the reference direction using the estimated setting position; and when the measured arrival angle falls within the calculated arrival angle range, determining that the vehicle reaching the predetermined position comprises the vehicle having said first radio communication unit.

8. The method according to claim 7, wherein said detecting of a vehicle shape comprises modeling the vehicle shape using the detected vehicle shape and outputting the vehicle shape as modeled vehicle shape data.

9. The method according to claim 7, wherein said calculating of an arrival angle range comprises:

setting a signal output range by said first radio communication unit using the estimated setting position, calculating the arrival angle range of the radio signal from said first radio communication unit using the set signal output range, and when the measured arrival angle falls within the calculated arrival angle range, determining that the vehicle comprises the vehicle having said first radio communication unit.

10. The method according to claim 7, further comprising detecting that the vehicle has reached the predetermined position.

11. A communication vehicle identification apparatus comprising:

a first radio communication device mounted on a vehicle;

a second radio communication device placed at a gate through which the vehicle passes to perform radio communication with said first radio communication device;

a directional finding unit for measuring an arrival angle of a radio signal transmitted from said first radio communication device with respect to a reference direction;

a vehicle classification device for detecting a shape of the vehicle using image data obtained by photographing the vehicle and outputting vehicle shape data; and a vehicle identification device for, when the vehicle has reached a predetermined position on the gate, determining whether the arrival angle output from said directional finding unit falls within an arrival angle range of the radio signal from said first radio communication device, which is calculated using the vehicle shape data from said vehicle classification device, and identifying the vehicle having said first radio communication device using a determination result.

12. The apparatus according to claim 11, wherein said vehicle identification device comprises an estimator for estimating a setting position of said first radio communication device using the vehicle shape data from said vehicle classification device, a calculator for, when the vehicle has reached the predetermined position, calculating the arrival angle range of the radio signal from said first radio communication device using the estimated setting position of said first radio communication device, and a determination device for, when the arrival angle measured by said directional finding unit falls within the arrival angle range calculated by said calculator, determining that the vehicle reaching the predetermined position comprises the vehicle having said first radio communication device.

13. The apparatus according to claim 11, further comprising a detector for detecting that the vehicle has reached the predetermined position on the gate, and the predetermined position is set at a position where said directional finding unit can detect the arrival angle of the radio signal from said first radio communication device.

14. The apparatus according to claim 11, wherein said vehicle classification device comprises an image sensing unit for photographing a side surface portion of the vehicle and outputting image data, and an image processing unit for detecting the shape of the vehicle using the image data from said image sensing unit and outputting the vehicle shape data.

15. The apparatus according to claim 14, wherein said image processing unit models the shape of a vehicle using the detected shape of the vehicle and outputs modeled vehicle shape data.

16. The apparatus according to claim 11, wherein when a plurality of vehicles are present in a communication area where radio communication can be performed, said second radio communication device time-divisionally assigns a radio signal transmission time to said first radio communication device of each of the plurality of vehicles, and said directional finding unit time-divisionally measures the arrival angle of the radio signal transmitted from said first radio communication device.

* * * * *